US006314690B1

(12) United States Patent
Lilie et al.

(10) Patent No.: US 6,314,690 B1
(45) Date of Patent: Nov. 13, 2001

(54) HIGH IMPACT EXTENDED STANDOFF WINDOW SCREEN

(75) Inventors: Glenn T. Lilie; Fred B. Arehart, both of Pearland, TX (US)

(73) Assignee: CPI Group, Inc., Pearland, TX (US)

( * ) Notice: Subject to any disclaimer, the term of this patent is extended or adjusted under 35 U.S.C. 154(b) by 0 days.

(21) Appl. No.: 09/444,185

(22) Filed: Nov. 19, 1999

(51) Int. Cl.[7] ..... E06B 3/964

(52) U.S. Cl. ..... 52/204.61; 52/204.62; 52/202; 52/204.6; 52/656.7; 52/656.8; 49/492.1; 49/484.1

(58) Field of Search ..... 52/202, 204.6, 52/204.61, 204.62, 656.8, 656.7, 656.1; 49/489.1, 492.1, 504, 484.1; 160/380, 371, 379

(56) References Cited

U.S. PATENT DOCUMENTS 4,932,457 * 6/1990 Duncan ..... 160/380
5,141,046 8/1992 Duncan .
5,906,083 * 5/1999 Olsen et al. ..... 52/473

* cited by examiner

*Primary Examiner*—Carl D. Friedman
*Assistant Examiner*—Patrick J. Chavez
(74) *Attorney, Agent, or Firm*—Bracewell & Patterson, L.L.P.

(57) ABSTRACT

A high strength window screen frame that includes an extruded metal frame that fits within a window opening in a building. The frame is made up of a plurality of window frame units, each defining an opening and covered with mesh. A standoff leg portion of the window frame units provides a standoff separation of the mesh from a glass pane so that when objects strike the mesh and deflect the mesh, the glass pane is not impacted.

12 Claims, 3 Drawing Sheets

10
11
11
11
12
16
17
17
17
18
18
18
26
26
26
36
36
37a
37b
38
41
41
64

10
11
11
11
12
14
17
17
17
18
18
18
20
20
24
24
35a
35a
35b
35b
64

HIGH IMPACT EXTENDED STANDOFF WINDOW SCREEN

TECHNICAL FIELD

The present invention relates to a window screen. More particularly, the invention relates to a window screen having strong components that may be used as an impact protective system, particularly for window protection from impacts due to debris from wind storms, hurricanes, tornados and the like, as well as vandalism.

BACKGROUND OF THE INVENTION

Windows are typically provided in structures such as residential homes, schools, office buildings and other buildings designed primarily for human occupation. Oftentimes it is desirable to allow for the windows to be opened so that outside air may enter the building. Screens are typically provided on such window openings so that air may pass through the window opening, but undesirable objects such as insects are kept outside of the building. Most prior art screens are made of aluminum mesh and do not have adequate strength to protect against window breakage. Also, whether the window can open or not, prior art screens are known that can protect window glass from damage, if strong enough.

In areas that are subject to high winds, such as areas that may experience hurricanes or tornados, it is desirable to provide a screen that will protect window glass from flying debris. Additionally, buildings that are prone to be vandalized, such as schools and low income housing, use screens to protect against glass breakage. One prior art screen that provides protection against glass breakage comprises stainless steel mesh within an aluminum frame.

However, in the prior art, the mesh and the glass are proximate one another. As a result, deflections of the mesh from impacts to the mesh by objects could result in glass breakage.

SUMMARY OF THE INVENTION

The invention of the application is a high strength window screen frame adapted to fit within a window opening in an exterior wall of a building in front of a window pane. The window screen frame includes an extruded metal frame that defines an opening for receiving mesh. A fascia portion of the extruded metal frame is provided on the frame proximate the opening. A standoff leg portion of the extruded metal frame extends rearward from the fascia portion. The standoff leg portion is longer than the fascia portion to provide sufficient separation between the window pane and the mesh to prevent deflections in the mesh from making contact with the window pane. Heavy duty mesh screen is preferably used with the high strength window screen frame of the invention. The window screen frame is screwed by fasteners to an exterior wall surrounding a window opening of a structure.

DETAILED DESCRIPTION OF THE INVENTION

Figure 1:
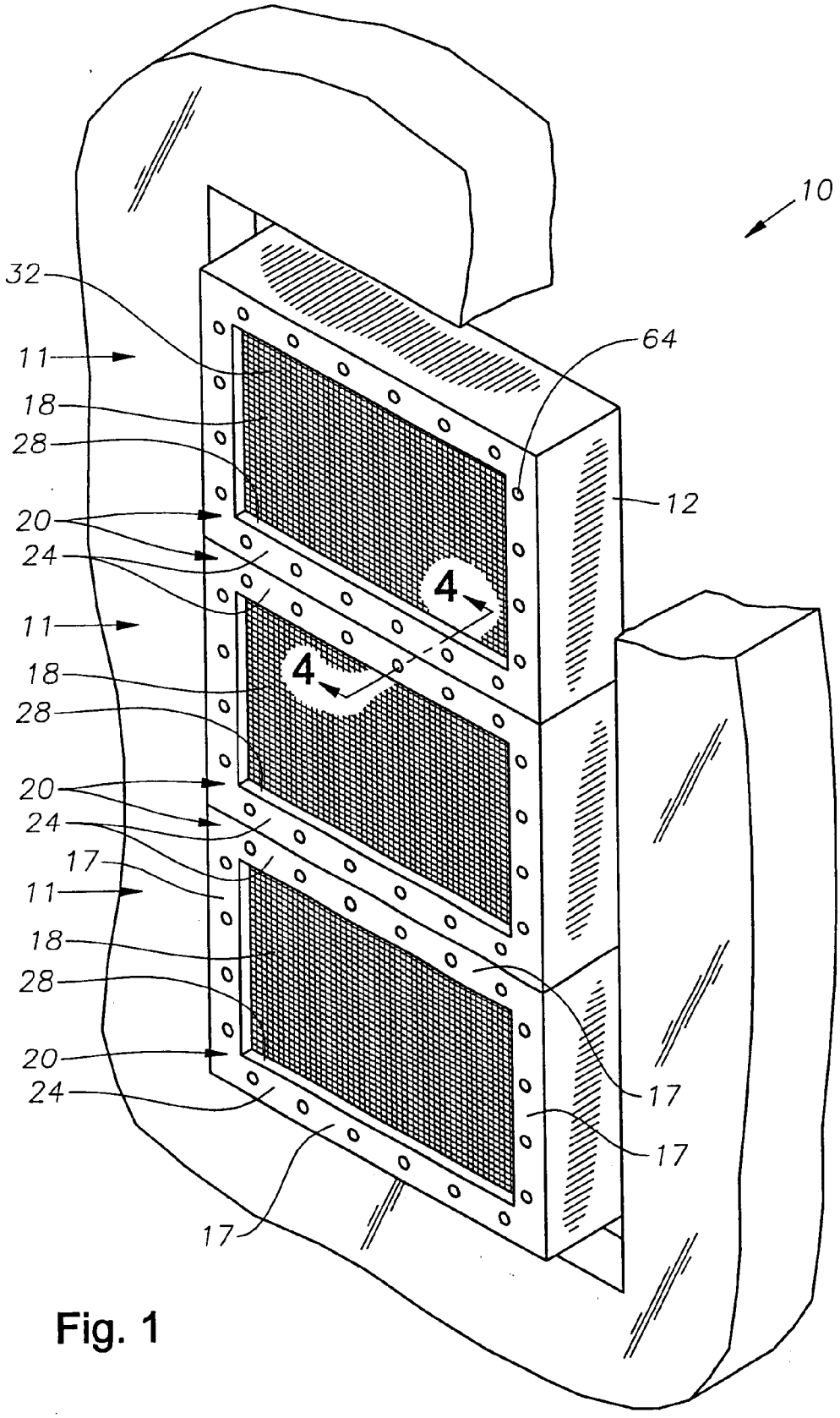
FIG. 1 is a perspective view of a window screen frame of the invention.
Figure 2:
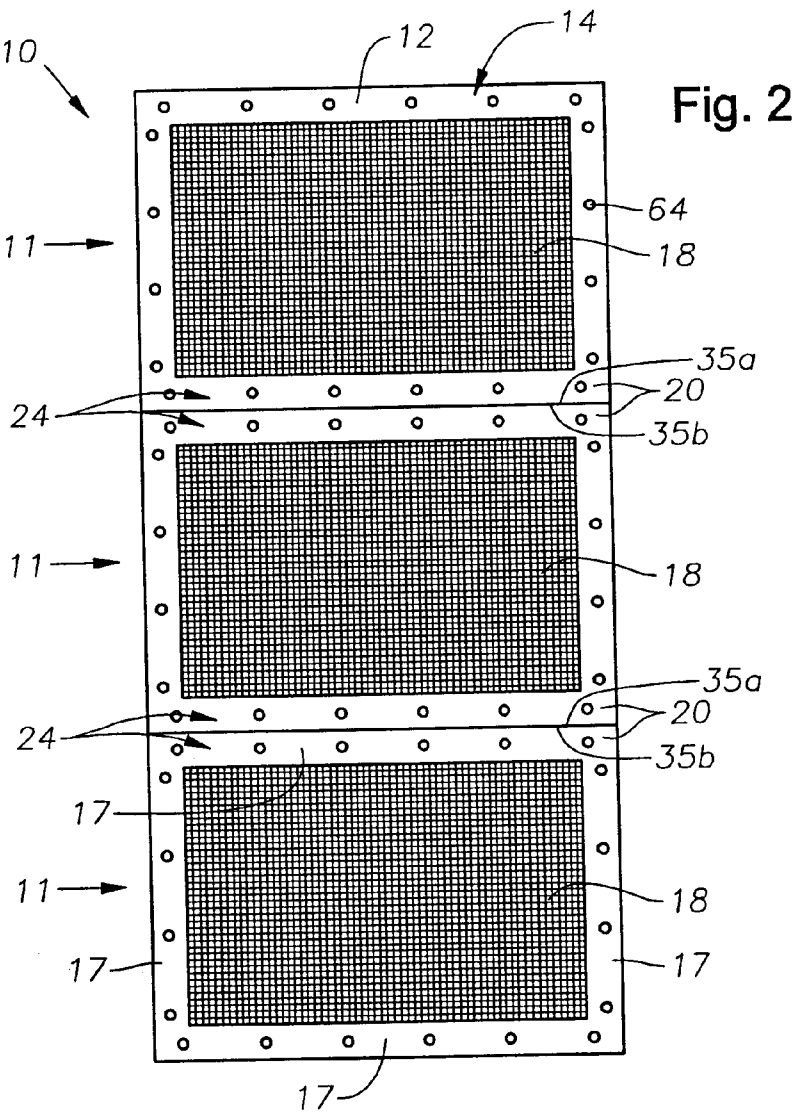
FIG. 2 is a front view of the window screen frame of FIG. 1.

Referring to FIG. 1, a high strength window screen frame 10 includes an extruded metal frame 12. Preferably, the extruded metal frame is a hollow extruded aluminum frame. Variations may exist in the cross-sectional configuration, depending upon building materials and the type of window used in conjunction with the high strength window frame 10. High strength window frame 10 is made up of window frame units 11 (FIGS. 1–3) mounted together to make up a single screen for a window. Window frame units 11 have a front 14, a back 16, and four frame members 17 that define an opening 18. Extruded metal frame 12 is designed to be used in conjunction with a window opening in a wall 13 of a structure.

Figure 3:
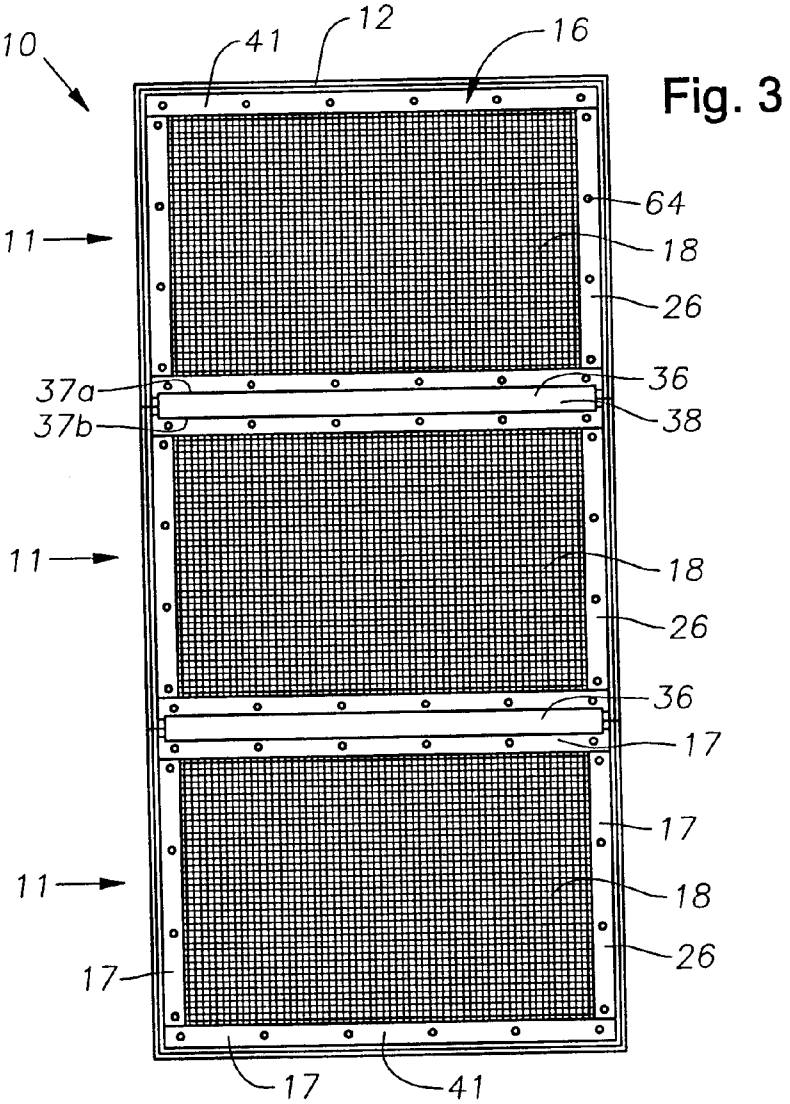
FIG. 3 is a back view of a screen frame of FIG. 1.
Figure 4:
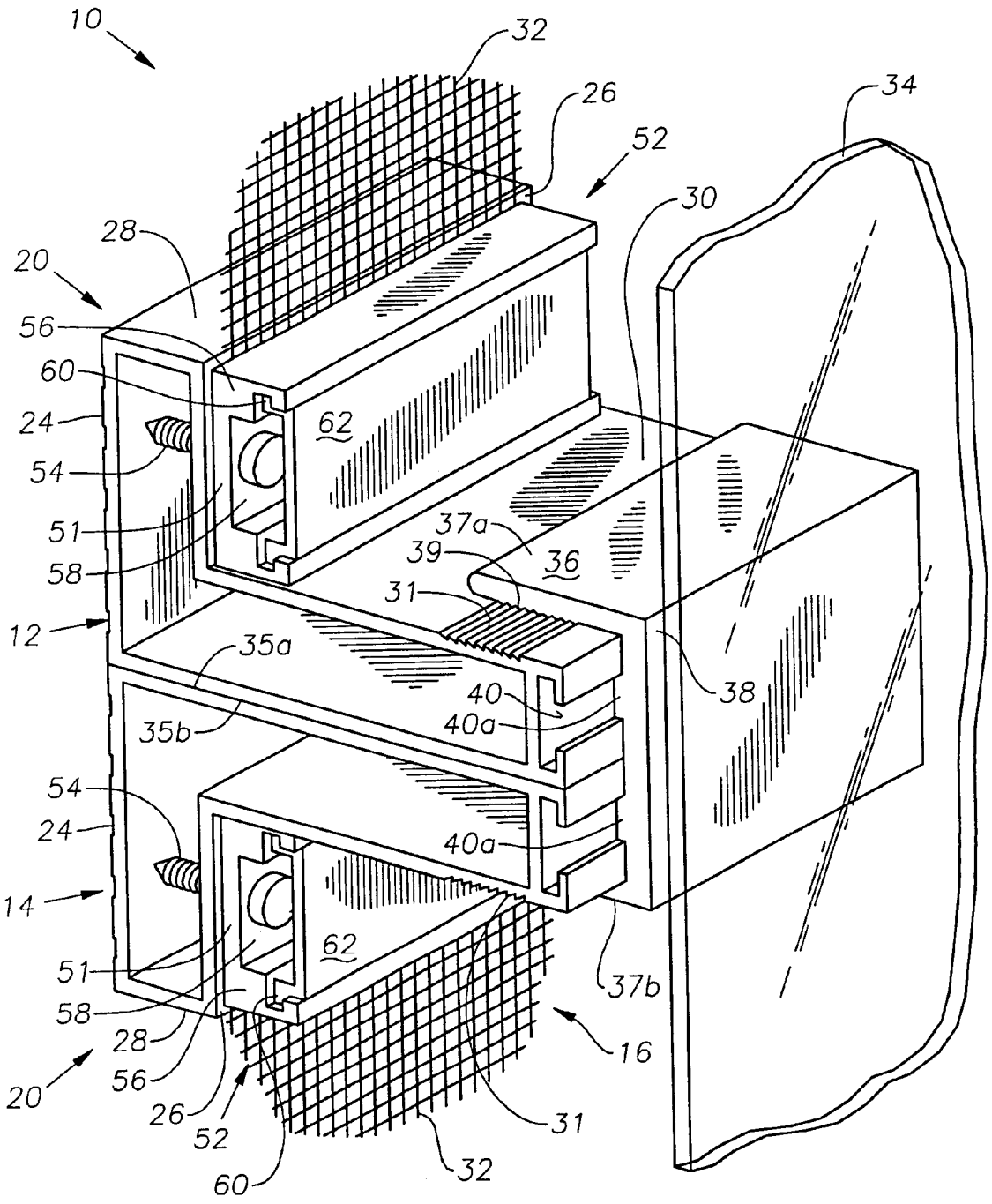
FIG. 4 is perspective cross sectional view of the window screen frame of the invention taken along line 4—4 of FIG. 1.

Frame 12 is L-shaped, having a fascia portion 20 (FIGS. 1, 2, and 4)of frame 12 that is provided on a forward end of extruded metal frame units 11 nearest openings 18. Screen plate portion 20 has a front face 24 FIGS. 1, 2, and 4), a rear face 26 (FIG. 3)and an inside surface 28. A standoff leg portion 30 (FIG. 4) of frame 12 extends rearwardly from fascia portion 20. Standoff leg portion 30 is provided with longitudinal teeth or serrations 31. Standoff leg portion 30 extends rearward from rear face 26 approximately 1.4 times the dimension of front face 24 from outer edge 35*b* of frame 12 to inside surface 28 in the preferred embodiment. Preferably, front face 24 is approximately 1.4 inches from outer edge 35*b* to inside surface 28 of frame 12, inside surface 28 is approximately 0.5 inches from front face 24 to rear face 26, and standoff leg portion 30 extends approximately 2.5 inches rearward from front face 24 to a rear face at groove 40. The relatively longer length of the standoff leg portion 30 results in an extended standoff of mesh 32 relative to glass pane 34 (FIG. 4). The standoff is between approximately 2 to 5 inches in the preferred embodiment, which protects glass pane 34 from damage that might occur from any deflection of mesh 32 that might be caused by an impact of an object with the mesh. It should be noted that the dimensions recited herein are provided for the purpose of example only. Other suitable dimensions may be used within the scope of the invention.

Within a single window, depending on the length, there may be several frame units 11. The upper edge 35*a* (FIGS. 1, 2, and 4) of the lowest frame unit 11 abuts the lower edge 35*b* (FIGS. 1, 2 and 4) of the next upward frame unit 11. The drawings show three frame units 11. A cap 36 (FIGS. 3 and 4) is provided to fit over ends of standoff leg portion 30 to secure multiple window frame units 11 together. Cap 36 is a metal channel member with two side walls 37*a*, 37*b* and a base 38 (FIGS. 3, 4). A serrated portion 39 (FIG. 4) is on an inside surface 38 of each sidewall 37*a*, 37*b* for engaging longitudinal serrations 39 on standoff leg portion 30. Standoff leg portions 30 are preferably provided with channels or grooves 40 that mate with a tongue 40*a* on cap 36. Additionally, end bracket supports 41 (FIG. 3) may be provided at ends of window frame units 11 that are not adjacent to other window frame units 11. End bracket supports 41 provide additional strength to window frame units 11.

Referring now to FIG. 4, a metal screen plate stiffener 52 is removably affixed to rear face 26 of fascia portion 20 with a plurality of self-tapping sheet metal screws 54. Screen plate stiffener 52 is a channel strip, having a pair of outer rims 56 and a base 57 that define a longitudinal channel 58. An inner slot 60 is formed on an inner surface of outer rims 56. A slidable plastic cover 62 is received within interior slots 60 on the screen plate stiffener 52. Screen plate stiffener 52 is secured to the rear face 26 for securing a heavy duty mesh screen 32. Screws 64 (FIGS. 1–3) extend through front face 24 and the standoff portions 30 of frame 12 around the perimeter of frame 12. Screws 64 engage structure within an opening in an exterior wall to secure frame 12 within the opening.

In use, the window screen frame 10 of the invention is positioned within an opening in wall 13. Screws 64 (FIGS. 1, 2 and 3) secure extruded metal frame 12 to wall 13. Screws 64 extend through frame 10 to secure window frame 12 within wall 13. Window pane 34 is recessed from mesh screen 32 a considerable distance. The extended standoff leg portion 30 provides a standoff distance from mesh 32 to glass pane 34 that provides additional protection to glass pane 34. Additionally, multiple window frame units 11 result in fascia portions 20 that extend horizontally across the face of the window frame 10. The fascia portions 20 are integral parts of the individual window frame units 11. The use of individual window frame units 11 provide strength to the window frame 10 and provide additional support to the mesh 32. Standoff leg portion 30 of adjacent window frame units 11, which contact one another, are secured together with cap 36.

The invention has numerous advantages. The window frame of the invention has features to protect window glass and to provide extra strength to the window frame. The high strength construction of the frame, when used in conjunction with heavy steel mesh screen, provides an impact protective system that protects window glass from flying debris. The extended standoff leg portion of the window frame provides an extended standoff of the window pane from the mesh screen. Additionally, the multiple window frame units are combinable to form a strong window frame having connected adjoining cross-members. The window frame of the invention provides strength and protection to windows and is an attractive alternative to other devices, such as burglar bars or boarding up windows. An additional advantage is that the high strength window screen frame of the invention may be easily installed on existing structures.

While the invention has been shown in only one of its forms, it should be apparent to those skilled in the art that it is not so limited, but is susceptible to various changes without departing from the scope of the invention.

What is claimed is:

1. A window screen comprising:

a rectangular frame having a generally L-shaped cross-section, defining a standoff leg portion and a fascia portion extending perpendicular to the standoff leg portion, the fascia portion having an outside surface and an inside surface defining an opening, the fascia portion having a front face and a rear face;

a mesh secured to the rear face of the fascia portion;

wherein said standoff leg portion extends rearward from said rear face of said fascia portion a dimension that is greater than a dimension of said fascia portion from said outside surface to said inside surface; wherein:

said window screen is comprised of more than one of said rectangular frames, with an upper one of said frames having a lower edge that abuts an upper edge of a lower one of said frames, each of said upper and lower edges having one of the fascia portions and one of said standoff leg portions, with said standoff leg portions of said upper and lower edges being adjacent one another;

said standoff leg portions at said upper and lower edges having rear faces that are flush with one another; and a cap snaps over said rear faces of said standoff leg portions to secure said upper and lower frames together.

2. The window screen according to claim 1 wherein:

said adjacent standoff leg portions of said upper and lower edges of said rectangular frames have serrated portions; and said cap engages said serrated portions of said rectangular frames with mating serrations on said cap.

3. The window screen according to claim 1 wherein:

each of said rear faces of said standoff portions of said upper and lower edges has a longitudinal groove thereon; and said cap has a longitudinal tongue that fits in mating engagement with each of said longitudinal grooves.

4. A window screen comprising:

upper and lower frame units, each frame unit being made of four frame members secured together in a rectangular configuration;

each frame member being generally L-shaped in cross-section, and having fascia portions and standoff leg portions perpendicular to each other, with an inside surface of the fascia portions defining an opening;

a mesh secured to a back surface of the fascia portions of each of the frame units; and wherein the frame member on a lower edge of said upper unit abuts and is fastened to the frame member on an upper edge of said lower unit.

5. A window screen comprising:

upper and lower frame units, each frame unit being made of four frame members secured together in a rectangular configuration;

each frame member being generally L-shaped in cross-section, and having fascia portions and standoff leg portions perpendicular to each other, with an inside surface of the fascia portions defining an opening;

a mesh secured to a back surface of the fascia portions of each of the frame units; and wherein the frame member on a lower edge of said upper unit abuts and is fastened to the frame member on an upper edge of said lower unit; wherein said window screen is comprised of more than one of said frame units, with an upper one of said frame units having a lower edge that abuts an upper edge of a lower one of said frame units, each of said upper and lower edges having one of said fascia portions and one of the standoff leg portions, with said standoff leg portions of said upper and lower edges being adjacent one another;

said standoff leg portions of said upper and lower edges have rear faces that are flush with one another; and a cap snaps over said rear faces of said standoff leg portions of said upper and lower edges to secure said upper and lower frame units together.

6. The window screen according to claim 5 wherein:

said adjacent standoff leg portions of said window frame units have serrated portions; and said cap engages said serrated portions of said window frame units with mating serrations on said cap.

7. The window screen according to claim 4 wherein:

said standoff leg portion of each of said frame members extends rearward from said back surface of said fascia portion a dimension that is greater than a dimension of from said inside surface to an outside surface of each of said fascia portions.

8. The window screen according to claim 5 wherein:

each of said rear faces of said standoff leg portions of said upper and lower edges has a longitudinal groove thereon; and said cap has a longitudinal tongue for mating engagement with each of said longitudinal grooves.

9. A building window assembly comprising in combination:

a window frame;

a pane of glass mounted in said window frame;

a window screen mounted in said window frame forward of said pane of glass, said window screen comprising:

upper and lower frame units, each frame unit being made of four frame members secured together in a rectangular configuration;

each frame member being generally L-shaped in cross-section, and having fascia portions and standoff leg portions perpendicular to each other, with an inside surface of the fascia portions defining an opening;

wherein a rear face of the standoff leg portion of said frame member on an upper edge of said lower frame unit and a rear face of the standoff leg portion of said frame member on a lower edge of said upper frame unit are spaced forward of said pane of glass;

a mesh secured to a back surface of the fascia portions of each of the frame units; and wherein the frame member on said lower edge of said upper frame unit abuts and is fastened to the frame member on said upper edge of said lower frame unit.

10. The window assembly according to claim 9 wherein:

said standoff leg portions of said abutting upper and lower edges have rear faces that are flush with one another; and a cap snaps over said rear faces of said standoff leg portions to secure said upper and lower frame units together.

11. The window assembly according to claim 9 wherein:

said abutting standoff leg portions of said upper and lower edges of said window frame units have serrated portions; and a cap secures said abutting standoff leg portions together by engaging said serrated portions of said window frame units with mating serrations on said cap.

12. The window assembly according to claim 9 wherein:

said standoff leg portion extends rearward from said fascia portion and said standoff leg portion is longer than said fascia portion is tall;

said standoff leg portion of each frame member extends rearward from said rear surface of said fascia portion a dimension that is greater a dimension from an outside surface of said fascia portion to said inside surface of said fascia portion.

* * * * *